US012545497B2

(12) United States Patent
Appleby

(10) Patent No.: US 12,545,497 B2
(45) Date of Patent: Feb. 10, 2026

(54) PROTECTIVE CONTAINER AND DISPENSER FOR ADHESIVE TAPE

(71) Applicant: Chris Appleby, Santa Fe, NM (US)

(72) Inventor: Chris Appleby, Santa Fe, NM (US)

( * ) Notice: Subject to any disclaimer, the term of this patent is extended or adjusted under 35 U.S.C. 154(b) by 0 days.

(21) Appl. No.: 18/757,119

(22) Filed: Jun. 27, 2024

(65) Prior Publication Data

US 2026/0001706 A1 Jan. 1, 2026

(51) Int. Cl.
*B65D 85/06* (2006.01)
*B65D 85/672* (2006.01)
*B65H 75/16* (2006.01)

(52) U.S. Cl.
CPC ..... *B65D 85/672* (2013.01); *B65H 75/16* (2013.01); *B65H 2701/377* (2013.01)

(58) Field of Classification Search
CPC ..... B65D 85/672; B65D 85/04; B65H 75/16; B65H 2701/377
USPC ..... 206/389, 403, 409
See application file for complete search history.

(56) References Cited

U.S. PATENT DOCUMENTS 3,746,225 A * 7/1973 Runckel ..... A61C 15/043 225/56
4,262,835 A * 4/1981 Wrobel ..... B65H 35/0026 225/25
5,058,792 A * 10/1991 Morand ..... A47K 10/3836 225/53
6,145,722 A * 11/2000 Behrens ..... B65H 35/0026 225/41
6,464,077 B1 * 10/2002 Liu ..... B65D 85/04 206/463
6,491,163 B1 * 12/2002 Grcic ..... B65H 55/046 242/163
D486,520 S 2/2004 Sherman et al.
7,198,151 B1 * 4/2007 Fomby ..... A45C 11/00 220/4.24
9,096,372 B2 * 8/2015 Vulpitta ..... B65H 75/16
10,273,037 B2 * 4/2019 Pan ..... B65D 43/0214
D855,696 S 8/2019 Lusson et al.
D880,291 S 4/2020 Meizlish et al.
D883,654 S 5/2020 Cain et al.
D929,606 S 8/2021 Forman et al.
D953,011 S 5/2022 Hood
11,673,733 B2 6/2023 Platt et al.
(Continued)

OTHER PUBLICATIONS

"Tape Tender", downloaded Sep. 12, 2023; https://www.bradyid.com/tape.

*Primary Examiner* — Steven A. Reynolds
(74) *Attorney, Agent, or Firm* — KPPB Law; Kermit D. Lopez; Luis M. Ortiz

(57) ABSTRACT

A container for dispensing adhesive tape can include a first lid and a second lid, wherein the first lid comprises a first central connector and the second lid can include a second central connector that includes a threaded portion that can be configured to engage with the first central connector to maintain and protect a roll of adhesive tape when the second central connector is connected to the first central connector by the threaded portion when the first lid and the second led are engaged with one another in a closed position and a central circular gap within the roll of adhesive tape surrounds the first central connector and the second central connector within the container.

13 Claims, 6 Drawing Sheets

(56) References Cited

U.S. PATENT DOCUMENTS

2006/0196989 A1* 9/2006 Bartley ..... B65H 49/08
242/605

* cited by examiner

PROTECTIVE CONTAINER AND DISPENSER FOR ADHESIVE TAPE

TECHNICAL FIELD

Embodiments are related to containers for protecting and dispensing adhesive tape such as masking, tape, painter's tape and so on. Embodiments are also related to containers that can prevent damage to adhesive tape during storage, transport and usage of such tape. Embodiments also relate to a protector/dispenser for adhesive tape.

BACKGROUND

Adhesive tape such as masking tape and painter's tape is useful in a variety of industries and applications. Painter's tape, also known as masking tape, is a type of adhesive tape designed for temporary use in various painting applications. It is characterized by its low-tack adhesive, which allows for easy removal without damaging surfaces or leaving behind sticky residue. Painter's tape is typically made of a thin paper or film backing, and it often comes in rolls.

Painter's tape is useful in applications such as painting and home improvement. For example, one of the primary uses of painter's tape is to mask off areas that should not be painted. It helps create clean and straight lines, preventing paint from bleeding onto adjacent surfaces. Painter's tape is also commonly used to protect trim, baseboards, and other surfaces while painting walls or ceilings. Painters tape is also used extensively in automotive painting and detailing, where painter's tape is used to mask off areas like windows, trim, and other parts of a vehicle that should not be painted. In arts and crafts, painter's tape can be used for various creative projects, such as creating geometric patterns, blocking off sections for different colors, or achieving specific design elements. Painter's tape is also often used in construction to mask off areas around windows and doors, protecting them from paint or other construction materials.

Painter's tape is a versatile tool that facilitates precision and cleanliness in various applications where controlled paint application is crucial. Its temporary nature and easy removal make it a popular choice for both professionals and DIY enthusiasts in a wide range of industries.

Adhesive tape such as painter's tape and masking tape, however, can be easily damaged during, storage, transport and/or usage for several reasons. The adhesive on painter's tape, for example, is designed to be low-tack, allowing for easy removal without damaging surfaces. However, this also makes it susceptible to damage if it comes into contact with surfaces that are too rough or if excessive force is applied during application or removal. If the tape is not torn cleanly along the edge of the roll, it can lead to frayed or uneven edges. This can make it challenging to apply the tape smoothly and create clean lines.

In addition, during transport or handling, a roll of painter's tape can be subjected to pressure or impact. If the pressure is uneven or if the roll is dropped, it can cause deformation or crushing of the tape, making it less effective. When a roll of painter's tape is damaged, the entire roll might become unusable. Painter's tape is often used to create precise and clean lines during painting. Any damage, such as uneven edges or tears, can compromise its ability to create sharp lines, affecting the quality of the painted surface.

If the adhesive is compromised due to damage, the tape may not adhere properly to surfaces. This can result in bleeding or seepage of paint under the tape, leading to smudged or uneven paint lines. A damaged roll may be more difficult to handle during application, making it challenging to achieve the desired level of precision. This can be especially problematic when working on intricate or detailed projects. The overall usability of a roll of painter's tape can be compromised if the tape is damaged, affecting its ability to adhere properly and create clean lines. Therefore, damaged rolls are often discarded to ensure the effectiveness and quality of the masking tape in future applications.

Conventional containers for painter's tape are often not particularly useful for transporting and protecting the tape for at least several reasons. First, many conventional containers lack a proper sealing mechanism. Painter's tape is sensitive to environmental factors such as dust, moisture, and air, which can affect its adhesive properties. Without a secure seal, these elements may compromise the quality of the tape over time. In addition, standard packaging for painter's tape may not provide sufficient protection against impacts or rough handling during transport. The tape can be susceptible to deformation, crushing, or tearing if the packaging does not offer adequate cushioning or protection.

Some conventional containers do not have a built-in dispensing mechanism. This can make it challenging to cleanly dispense the tape, leading to potential damage or uneven tearing that affects its usability during application. The packaging for painter's tape is often made from materials that may not withstand external stressors, such as being tossed or stacked with other items during transport. This can result in damaged packaging and, subsequently, damaged tape.

Conventional containers may lack user-friendly features that enhance convenience. For example, they may not have a tear strip for easy opening or a built-in cutter for precise tape cutting. This can make it cumbersome for users to access the tape and may contribute to accidental damage. Traditional packaging may not be designed for space efficiency, leading to bulkier containers that take up more space during storage and transportation. This can be inconvenient, especially when transporting multiple rolls.

Choosing painter's tape with improved packaging or using additional protective measures during transport can help ensure that the tape remains in optimal condition, ready for use when needed.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the embodiments to provide for an improved container for storing, protecting and transporting adhesive tape such as painter's tape.

It is another aspect of the embodiments to provide for a container for storing adhesive tape that can be easily accessed by a user through a gap formed in the container's walls.

It is a further aspect of the embodiments to provide for a container that contains first and second connectors for maintaining adhesive tape within the container.

It is also an aspect of the embodiments to provide for a donut-shaped container for maintaining dispensing tape maintained with the container.

It is yet another aspect of the embodiments to provide for a protector/dispenser for adhesive tape.

The aforementioned aspects and other objectives and advantages can now be achieved as described herein. In an embodiment, a container for adhesive tape can be implemented, which can include a first lid and a second lid, wherein the first lid comprises a first central connector and the second lid comprises a second central connector comprising a threaded portion that is configured to engage with the first central connector to maintain and protect a roll of adhesive tape when the second central connector is connected to the first central connector by the threaded portion when the first lid and the second led are engaged with one another in a closed position and a central circular gap within the roll of adhesive tape surrounds the first central connector and the second central connector within the container.

An embodiment can further include a raised portion connected to the first lid and the first central connector, wherein the raised portion is located between an inner surface of the first lid and the first central connector.

In an embodiment, the first lid and the second lid are each circularly shaped.

In an embodiment, the first central connector and the second central connector can be each circularly shaped.

In an embodiment, the first lid may be configured with a first gap and the second lid can be configured within a second gap such that when the first lid is engaged with the second lid in a closed gap adhesive tape from the roll of adhesive tape passes through a complete gap formed from the first gap and the second gap to permit a user to access the adhesive tape while the roll of adhesive tape is maintained within the container.

In an embodiment, a flange portion may be located on the first lid and the second lid and within the first gap and second gap.

In an embodiment, the first lid and the second lid can engage with one another in a donut-shaped configuration.

In an embodiment, a flange portion can be located on the first lid and the second lid and within the first gap and second gap.

In an embodiment, a flange portion can be located on the first lid and the second lid within a gap through the adhesive tape is dispensed.

In an embodiment, the first lid can be configured with a gap to permit a user to access the adhesive tape while the roll of adhesive tape is maintained within the container.

In an embodiment, the second lid can be configured with a gap to permit a user to access the adhesive tape while the roll of adhesive tape is maintained within the container.

In an embodiment, the first lid can be configured with an upper lip and the second lid can be configured with a lower lip, wherein the upper lip can engage with the lower lip to assist in creating a circumferential seal between the first lid and second lid.

In an embodiment, a locking mechanism can be formed from the first central connector and the second central connector when connected to one another, wherein the locking mechanism locks the first lid to the second lid in a closed position.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the detailed description of the invention, serve to explain the principles of the present invention.

Figure 1:
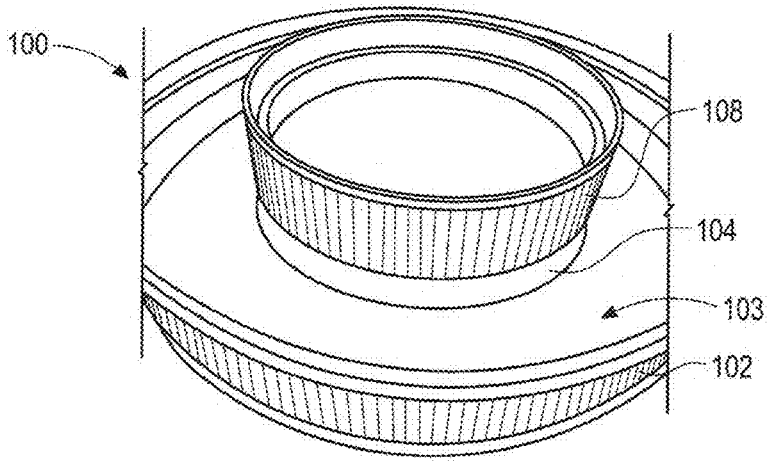
FIG. 1 illustrates a perspective view of a first lid of a container for maintaining and protecting a roll of adhesive tape, in accordance with an embodiment.

Like reference numerals or reference symbols in the various drawings may indicate like or similar elements. The particular values and configurations discussed in these non-limiting examples can be varied and are cited merely to illustrate one or more embodiments and are not intended to limit the scope thereof.

DETAILED DESCRIPTION

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Furthermore, the term "at least one" as utilized herein can refer to "one or more". For example, "at least one widget" may refer to "one or more widgets."

FIG. 1 illustrates a perspective view of a first lid 102 of a container 100 for maintaining and protecting a roll of adhesive tape (not shown in FIG. 1), in accordance with an embodiment. It should be appreciated that only a portion of the container 100 is shown in FIG. 1 in the form of the first lid 102. A second lid (not shown in FIG. 1) can engage with the first lid 102 to form the full container 100, which is depicted and described further below with respect to one or more of the other figures.

The first lid 102 includes an indented portion 103 within which a first central connector 108 is located centrally within the indented portion 103. A raised portion 104 can be connected to the first lid 102 and the first central connector 108. The raised portion 104 is located generally between an inner surface of the first lid 102 and the first central connector 108. It should be appreciated that the raised portion 104 is not necessarily required in all embodiments. That is, in other embodiments, the first central connector 108 may connect or attach directly to the first lid 102 in a manner that encompasses the space previously filled by the raised portion 104. In the particular embodiment shown in FIG. 1, the raised portion may form as a base to which the first central connector 108 may be located and attached to the first lid 102 within the indented portion 103.

Figure 2:
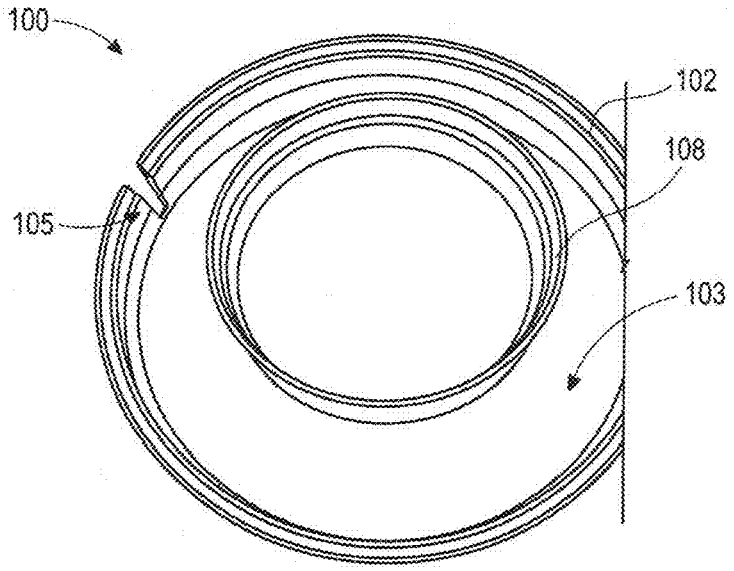
FIG. 2 illustrates a top view of the first lid of the container shown in FIG. 1, in accordance with an embodiment.

FIG. 2 illustrates a top view of the first lid 102 of the container 100 shown in FIG. 1, in accordance with an embodiment. In the configuration shown in FIG. 2, a spacing or gap 105 may be formed within the walls of the first lid 102. This gap 105 may form a part of a larger gap or inset through which tape from a roll of adhesive tape (e.g., painter's tape) may extend for usage by a user of the roll of adhesive tape when the roll of tape is maintained and protected within the container 100.

Figure 3:
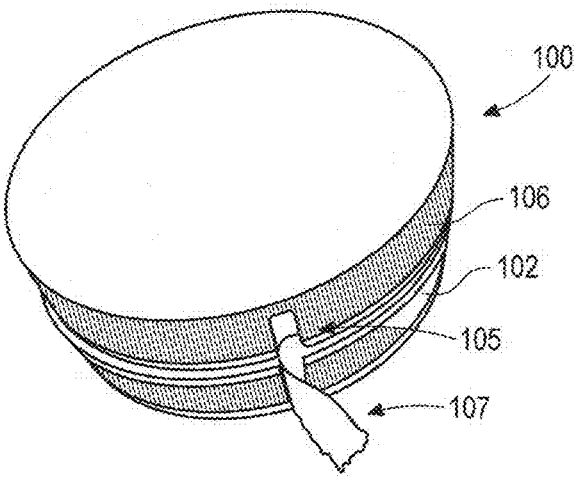
FIG. 3 illustrates a perspective view of a container for adhesive tape with the first lid and the second lid engaged with one another in a closed position, in accordance with an embodiment.

FIG. 3 illustrates a perspective view of a container 100 for maintaining and protecting adhesive tape with the first lid 102 and a second lid 106 engaged with one another in a closed position, in accordance with an embodiment. A roll of adhesive tape 107 is maintained within the container 100 and the full spacing or gap 105 is shown through which tape 107 can extend for access and usage by a user of the tape 107.

Figure 4:
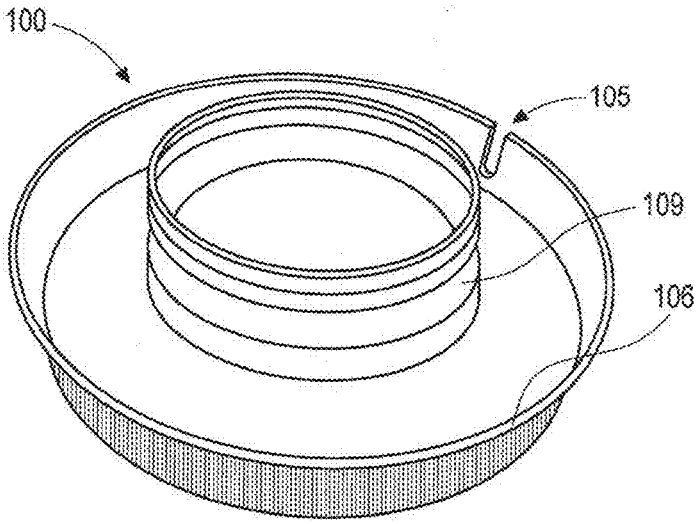
FIG. 4 illustrates a perspective view of a second lid of a container for adhesive tape, in accordance with an embodiment.

FIG. 4 illustrates a perspective view of the second lid 106 of the container 100 for maintaining and protective adhesive tape 107, in accordance with an embodiment. The second 106 can be configured with a second central connector 102 comprising a threaded portion. That is, a portion of the sides or walls of the second central connector 102 is configured with a threaded portion or threaded walls that can engage with the first central connector 108 of the first lid 102.

Figure 5:
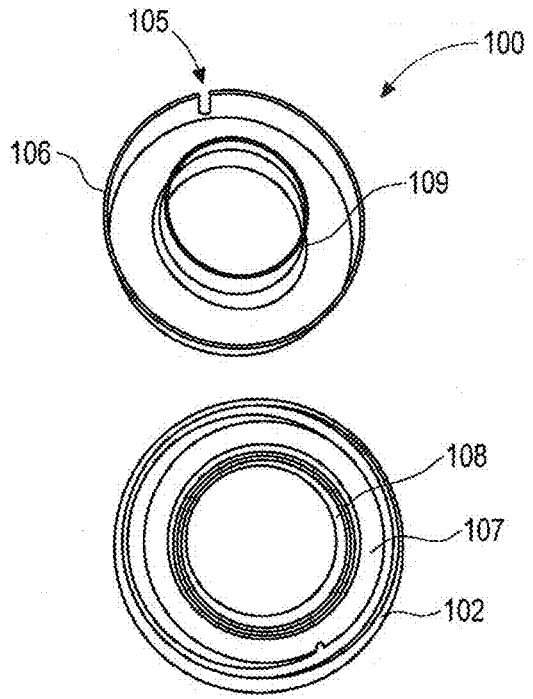
FIG. 5 illustrates a view of the first and second lids separated from one another and with the roll of adhesive tape engaged with the first lid, in accordance with an embodiment.
Figure 6:
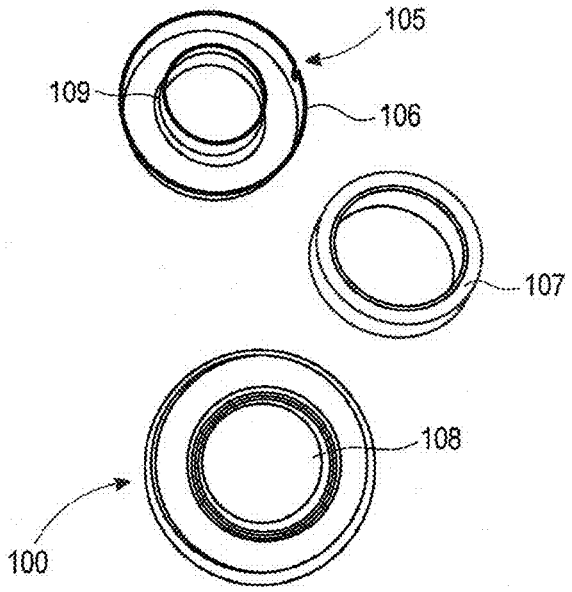
FIG. 6 illustrates a view of the first and second lids and the roll of adhesive tape separated from one another, in accordance with an embodiment.

FIG. 5 illustrates a view of the first lid 102 and the second lid 106 separated from one another and with the roll of adhesive tape 107 engaged with the first lid, in accordance with an embodiment. The various components of the container 100 are thus shown spread out from one another on a flat surface in the illustration of FIG. 5. FIG. 6 illustrates another view of the first lid 102 and the second lid 106 and the roll of adhesive tape 107 separated from one another, in accordance with an embodiment.

The container 100 thus can include the first lid 102 and the second lid 106, wherein the first lid 102 comprises the first central connector 108 and the second lid 106 comprises the second central connector 109 (which includes the threaded portion), which is configured to engage with the first central connector 108 to maintain and protect a roll of adhesive tape 107 when the second central connector 109 is connected to the first central connector 108 by the threaded portion of the second central connector 109 when the first lid 102 and the second led 106 are engaged with one another in a closed position. A central circular gap within the roll of adhesive tape surrounds the first central connector 108 and the second central connector 109 within the container 100.

The container 100 offers several advantages in terms of storing, maintaining, protecting, and transporting the adhesive tape 107. The threaded engagement between the first central connector 108 on the first lid 102 and the second central connector 109 on the second lid 106 provides a secure closure mechanism. This threaded connection ensures that the container 100 remains closed, protecting the roll of adhesive tape 107 from dust, moisture, and other environmental factors that could compromise its adhesive properties.

The presence of a central circular gap within the roll of adhesive tape, surrounding both the first and second central connectors, enhances the protective nature of the container 100. This design minimizes the risk of the adhesive tape becoming damaged or losing its adhesive qualities during storage and transportation. The inclusion of the raised portion 104 connected to the first lid 102 and the first central connector 108 contributes to the stability of the container 100. This raised portion helps prevent direct contact between the adhesive tape and the inner surface of the first lid 102, reducing the likelihood of unintentional damage to the tape 107.

The circular shape of both the first lid 102 and the second lid 108, as well as the circular shape of the first and second central connectors, provides a symmetrical and uniform design. This not only enhances the aesthetic appeal of the container but also allows for easy handling and stacking, making it convenient for storage and transportation.

The design of the first and second lids with respective gaps (i.e., gap 105) ensures that adhesive tape 107 from the roll can pass through a complete gap when the lids are engaged in a closed position. This feature allows users to conveniently access the adhesive tape without the need to fully open the container, facilitating easy dispensing while keeping the remaining tape 107 protected inside.

In summary, the container 100 offers a combination of secure closure, protection, stability, and user convenience, making it well-suited for the storage, maintenance, protection, and transportation of adhesive tape.

It can be appreciated that the container 100 may be implemented in other embodiments with other features and variations to those shown and described above. For example, in some embodiments, the first lid further can be configured with a sealing gasket along the circumference of the first central connector, and the second lid can include a corresponding recess to accommodate the sealing gasket, thereby providing an additional sealing mechanism to protect the roll of adhesive tape from external elements.

The container 100 may also be equipped with an adjustable tension mechanism associated with the threaded portion of the second central connector, allowing users to vary the tension applied to the roll of adhesive tape based on specific application requirements. In still other embodiments, the material of the first and second lids can include a temperature-responsive element configured to contract or expand based on ambient temperature, providing adaptive protection to the adhesive tape against temperature-induced changes in the storage environment. In still other embodiments, the container 100 may include an integrated cutting mechanism within the first central connector, facilitating convenient and precise cutting of the adhesive tape directly from the container.

In another embodiment, at least one of the first and second lids can be equipped with an indicator window or element allowing visual inspection of the remaining length or status of the adhesive tape within the container. In still other embodiments, the first and second lids can be reinforced with impact-resistant materials or structures, providing enhanced durability and protection for the adhesive tape during transportation and handling. The first and second lids can also be configured in some embodiments with customizable patterns, colors, or branding elements, allowing for personalized aesthetics and branding options for the container.

These additional features such as enhanced sealing, adjustable tension, temperature-responsive protection, integrated cutting, status indicators, reinforced structure, and customizable designs can further improve the functionality and versatility of the adhesive tape container 100.

Figure 7:
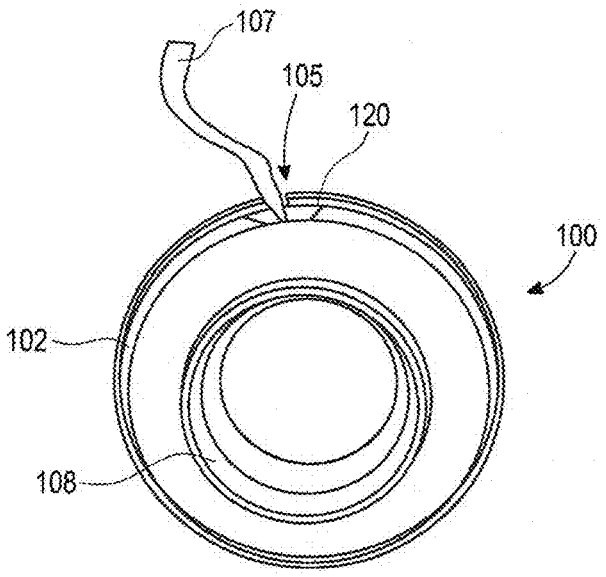
FIG. 7 illustrates a sectional view of the first lid of the adhesive tape container with a roll of the adhesive tape mounted on the first central connector, in accordance with an alternative embodiment.

FIG. 7 illustrates a sectional view of the first lid 102 of the adhesive tape container 100 with a roll of the adhesive tape 107 mounted on the first central connector 108, in accordance with an alternative embodiment. In the embodiment shown in FIG. 7, a flange portion 120 can be incorporated, which can be configured in a 45 degree angular arrangement to assist in avoiding shifting of the tape 107 as it is spooled from the adhesive tape container 100 and thereby avoid damaging the tape 107. The flange portion 120 can be located along the edges of the gap through which the tape 107 can be spooled. The flange portion 120 can be located and on both the first lid 102 and the second lid 106 to assist in preventing damage to the tape 107 as it is spooled from the adhesive tape container 100. FIG. 7 also shows the first central connector 108 around which the tape 107 is maintained within the container 100.

Figure 8:
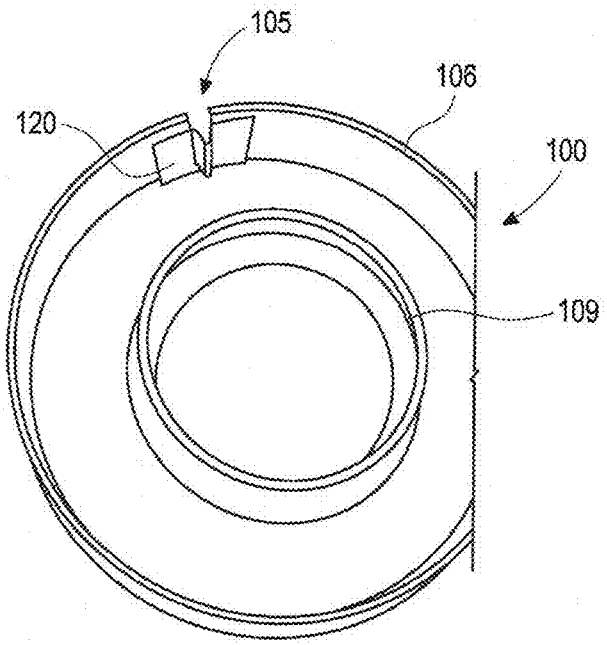
FIG. 8 illustrates a view of the second lid with the flange portion, in accordance with an alternative embodiment.

FIG. 8 illustrates a view of the second lid 106 with the flange portion 120, in accordance with an alternative embodiment. The second lid 106 can connect to the first lid 102 screwing of the first central connector 108 to the second central connector 109 of the second lid 106. The first central connector 108 and the second central connector 109 together function as a screw-on hub that allows for the connection of the first lid 102 to the second lid 106.

The flange portion 120 is also shown in FIG. 8 with respect to the second lid 106. The flange portion 120 can function as a gasket located on each side of the adhesive tape container 100 with respect to the gap 106 (or slot) to keep the tape 107 centered in the gap 105. FIG. 8 also depicts the second central connector 109. The second central connector 109 together with the first central connector 108 can form a locking mechanism for locking the two lids 102 and 106 to one another.

Figure 9:
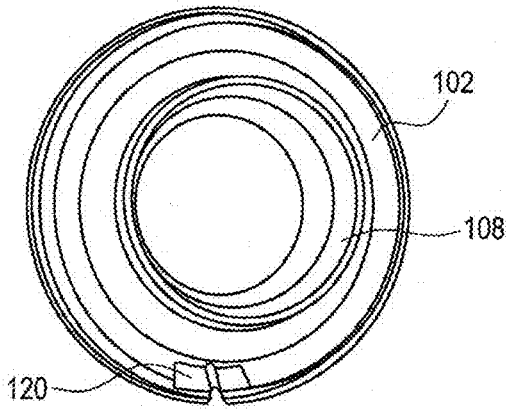
FIG. 9 illustrates a view of the first lid with the flange portion, along with the first central connector, in accordance with an alternative embodiment.
Figure 10:
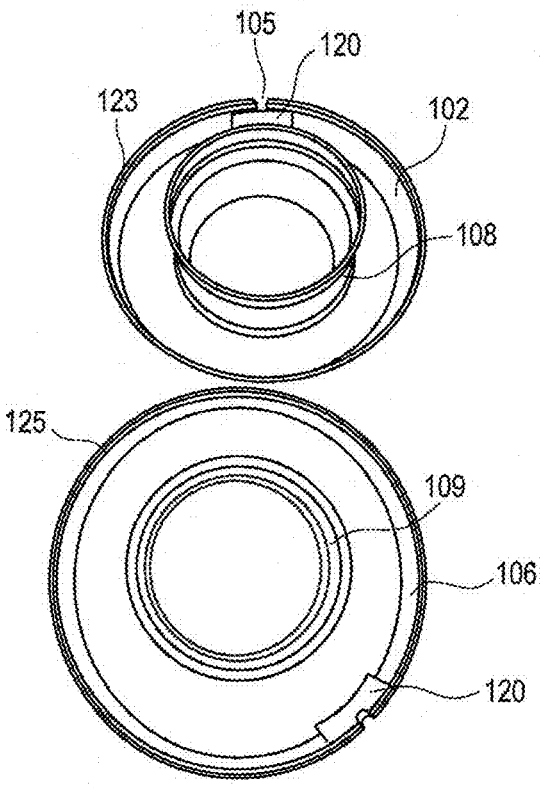
FIG. 10 illustrates a view of both the first lid and the second lid along with both pieces of the flange portion, in accordance with an alternative embodiment.

FIG. 9 illustrates a view of the first lid 102 with the flange portion 120, along with the first central connector 108, in accordance with an alternative embodiment. FIG. 10 illustrates a view of both the first lid 102 and the second lid 106 along with both pieces of the flange portion 120. Note that in FIG. 10, the first lid 102 may be configured with an upper lip 123 that can engage with a lower lip 125 configured on the second 106.

Alternatively, the lip arrangement may be modified so that the first lid 102 is equipped with a lower lip and the second lid 106 is configured with the upper lip. In either case, the lower lip and the upper lip may engage with one another to assist in maintaining the first lid 102 and the second lid 106 connected to one another that allows the tape 107 to move seamlessly through the gap 105. The lower lip and the upper lip can engage with one another to assist in creating a circumferential seal between the first lid 102 and second lid 106.

Note that the embodiment shown in FIGS. 7-9 is different from the embodiments shown in the earliest figures. Although containing similar parts and elements, the embodiment of FIGS. 7-9 is essentially implemented as a donut shaped container/dispenser for dispensing the tape 107 with a ridge or lips (e.g., such as the lips discussed above) that help to facilitate the seal, which in turn creates a smooth surface between the first lid 102 and second lid 106 when connected to one another. These lips can each be configured in a ridge shaped portion and may be configured from plastic or rubber.

Figure 11:
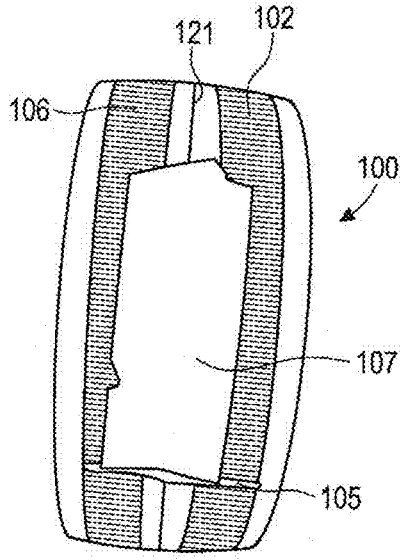
FIG. 11 and FIG. 12 illustrate respective side and perspective views of the adhesive tape container in a locked position in which the first lid connected to the second lid, in accordance with an embodiment.
Figure 12:
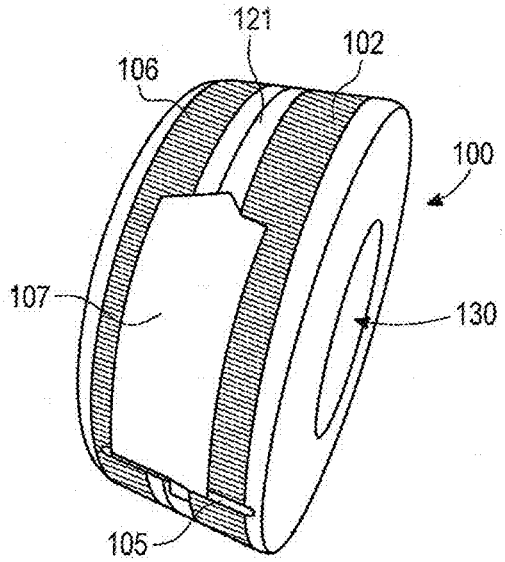

FIG. 11 and FIG. 12 illustrate respective side and perspective views of the adhesive tape container 100 in a locked position in which the first lid 102 is connected to the second lid 106. In the view shown in FIG. 11 and FIG. 12, the tape 107 is shown as spooled partially through the gap 105 and placed on the central seam 121 formed between the first lid 102 and the second lid 106 when the two lids connect to one another. The view shown in FIG. 12 shows the central circular gap 130 formed to give this embodiment its donut-shaped configuration.

It should be appreciated that the adhesive tape container 100 in its various embodiments presents a unique solution for maintaining and protecting rolls of tape such as tape 107. Featuring two circular lids, each equipped with central connectors, the container 100 ensures secure storage by engaging these connectors via a threaded portion. This design facilitates easy access to the tape 107 while safeguarding it within the container. Moreover, the container 100 can accommodate tapes of varying diameters and sizes through a central circular gap surrounding the connectors. This versatility enhances its utility across different tape types.

Critical to its innovation is the internal locking mechanism formed by the central connectors. Unlike conventional external tabs prone to breakage, this internal device provides robust security without risk of damage, ensuring long-lasting functionality/. With additional features such as raised portions for stability and flange portions for seamless tape dispensing, this container offers comprehensive tape management capabilities. The container 100 can not only revolutionize tape storage with its adaptable design but also prioritizes durability and user convenience through its unique locking mechanism and other unique combinations of features.

It should be appreciated that the adhesive tape 107 disclosed herein may come in various types, each tailored to specific applications and requirements. Examples of tape 107 include, for example, masking tape, painter's tape, duct tape, electrical tape, double-sided tape, packaging tape, and gaffer tape, to name a few types of example tapes.

Masking tape is a versatile type of adhesive tape primarily used in painting applications. It features a paper backing with a pressure-sensitive adhesive that offers temporary adhesion without leaving residue. It's commonly used to mask off areas when painting to achieve clean edges and protect surfaces from paint drips or splatters. Painter's tape is similar to masking tape but is specifically designed for painting tasks. It usually has a higher adhesion strength compared to masking tape and is available in different widths to accommodate various painting needs. Painter's tape is also known for its clean removal without damaging surfaces or leaving behind adhesive residue.

Duct tape is a robust adhesive tape with a cloth or scrim backing coated with a strong adhesive. It's highly durable and weather-resistant, making it suitable for a wide range of applications, including sealing, repairing, and bundling. Duct tape is known for its strength and versatility, often used in construction, automotive repair, and DIY projects. Electrical tape is designed specifically for electrical insulation and protection. It typically has a vinyl backing with a pressure-sensitive adhesive that provides excellent electrical insulation properties. Electrical tape is commonly used to insulate electrical wires, splice connections, and provide protection against moisture and abrasion in electrical installations.

Double-sided tape features adhesive on both sides, allowing it to bond two surfaces together. It's commonly used for mounting applications, such as attaching posters or securing carpets, where a strong, invisible bond is required. Double-sided tapes come in various adhesive strengths and backing materials to suit different surfaces and applications. Packaging tape, also known as parcel tape or shipping tape, is designed for sealing boxes and packages for shipping or storage. It typically has a strong adhesive backing and is available in various widths and thicknesses to accommodate different packaging needs. Packaging tapes may be made of materials like polypropylene or PVC and are often resistant to tearing and splitting.

Gaffer tape, also known as gaff tape, is a heavy-duty adhesive tape with a cloth backing and strong adhesive. It's commonly used in the entertainment industry for securing cables, labeling equipment, and temporarily taping down stage props. Gaffer tape is known for its residue-free removal and is available in various colors to blend in with different surfaces.

These are just a few examples of adhesive tapes available in the market. Other specialized tapes include carpet tape, medical tape, foam tape, and safety tape, each designed to meet specific application requirements and environmental conditions.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A container for adhesive tape, comprising:

a first lid and a second lid, each having a circular shape, wherein the first lid comprises a first central connector and the second lid comprises a second central connector comprising a threaded portion that is configured to engage with the first central connector to maintain, protect and dispense a roll of adhesive tape when the second central connector is connected to the first central connector by the threaded portion when the first lid and the second lid are engaged with one another in a closed position, wherein the first and second central connectors are concentrically aligned and symmetrically disposed within the container, wherein the first and second lids form a symmetric cylindrical enclosure around the roll of the adhesive tape, wherein a central gap within the roll of adhesive tape surrounds the first central connector and the second central connector within the container when the roll of adhesive tape is disposed within the container, and wherein the first lid is configured with a first gap and the second lid is configured within a second gap such that when the first lid is engaged with the second lid in a closed gap adhesive tape from the roll of adhesive tape passes through a complete gap formed from the first gap and the second gap to permit a user to access the adhesive tape while the roll of adhesive tape is maintained within the container.

2. The container of claim 1 further comprising a raised portion connected to the first lid and the first central connector, wherein the raised portion is located between an inner surface of the first lid and the first central connector.

3. The container of claim 1 wherein the first central connector and the second central connector are each circularly shaped.

4. The container of claim 1 wherein a flange portion is located on the first lid and the second lid and within the first gap and second gap.

5. The container of claim 1 wherein the first lid and the second lid engage with one another in a donut-shaped configuration that creates a smooth continuous interior surface to create a moisture/debris seal.

6. The container of claim 1 wherein a flange portion is located on the first lid and the second lid and within the first gap and the second gap and wherein the smooth continuous interior surface comprises an unobstructed surface that comprises a hand hold for ease of use by a user.

7. The container of claim 1 wherein the first lid is configured with an upper lip and the second lid is configured with a lower lip, wherein the upper lip engages with the lower lip to assist in creating a circumferential seal between the first lid and second lid.

8. The container of claim 1 further comprising a locking mechanism formed from the first central connector and the second central connector when connected to one another.

9. The container of claim 1 wherein threaded portion on a female connector side comprises an interior shoulder that when connected to a male connector side of the threaded portion creates a tight seal and a stop for the first and second central connectors, which allows for an opening for the roll of adhesive tape to in a proper placement when the first and second lids are fully engaged with one another.

10. The container of claim 1 further comprising a locking mechanism formed from the first central connector and the second central connector when connected to one another, wherein the locking mechanism locks the first lid to the second lid in a closed position.

11. The container of claim 1 wherein the first lid is configured with an upper lip and the second lid is configured with a lower lip.

12. The container of claim 11 wherein the upper lip engages with the lower lip to assist in creating a circumferential seal between the first lid and second lid and wherein the threaded portion comprises continuous threads that engage with one another to facilitate the connection of the second central connector to the first central connector by the threaded portion.

13. A container for adhesive tape, comprising:

a first lid and a second lid, each having a circular shape, wherein the first lid comprises a first central connector and the second lid comprises a second central connector comprising a threaded portion that is configured to engage with the first central connector to maintain, protect and dispense a roll of adhesive tape when the second central connector is connected to the first central connector by the threaded portion when the first lid and the second lid are engaged with one another in a closed position, wherein the first and second central connectors are concentrically aligned and symmetrically disposed within the container, wherein the first and second lids form a symmetric cylindrical enclosure around the roll of the adhesive tape, and wherein a central gap within the roll of adhesive tape surrounds the first central connector and the second central connector within the container when the roll of adhesive tape is disposed within the container; and a raised portion connected to the first lid and the first central connector, wherein the raised portion is located between an inner surface of the first lid and the first central connector, wherein the first lid is configured with a first gap and the second lid is configured within a second gap such that when the first lid is engaged with the second lid in a closed gap adhesive tape from the roll of adhesive tape passes through a complete gap formed from the first gap and the second gap to permit a user to access the adhesive tape while the roll of adhesive tape is maintained within the container.

* * * * *